US007977298B2

(12) United States Patent
Joinson

(10) Patent No.: US 7,977,298 B2
(45) Date of Patent: Jul. 12, 2011

(54) LAUNDRY ARTICLES

(75) Inventor: Leslie Joseph Luke Joinson, Bebington (GB)

(73) Assignee: The Sun Products Corporation, Wilton, CT (US)

( * ) Notice: Subject to any disclaimer, the term of this patent is extended or adjusted under 35 U.S.C. 154(b) by 216 days.

(21) Appl. No.: 11/824,063

(22) Filed: Jun. 29, 2007

(65) Prior Publication Data

US 2008/0004198 A1 Jan. 3, 2008

(30) Foreign Application Priority Data

Jun. 30, 2006 (GB) ..... 0613069.4

(51) Int. Cl.

| | |
|---|---|
| ***C11D 17/04*** | (2006.01) |
| ***C11D 3/386*** | (2006.01) |
| ***D06L 1/00*** | (2006.01) |
| ***B08B 7/00*** | (2006.01) |

(52) U.S. Cl. ..... 510/296; 510/320; 510/439; 8/137; 134/25.4; 134/42

(58) Field of Classification Search ..... 510/296, 510/439, 320; 8/137; 134/25.4, 42
See application file for complete search history.

(56) References Cited

U.S. PATENT DOCUMENTS

| | | | | |
|---|---|---|---|---|
| 4,776,455 | A * | 10/1988 | Anderson et al. | 206/0.5 |
| 6,448,212 | B1 * | 9/2002 | Holderbaum et al. | 510/296 |
| 2001/0031714 | A1 | 10/2001 | Gassenmeier et al. | 510/276 |
| 2003/0069155 | A1 * | 4/2003 | Mangin et al. | 510/297 |
| 2003/0134766 | A1 * | 7/2003 | Jones et al. | 510/293 |

FOREIGN PATENT DOCUMENTS

| | | | |
|---|---|---|---|
| DE | 100 03 429 | | 9/2000 |
| EP | 0 414 462 | | 2/1991 |
| EP | 0 593 952 | | 4/1994 |
| EP | 1 126 070 | | 8/2001 |
| EP | 1 516 918 | | 3/2005 |
| GB | 2 374 830 | | 10/2002 |
| GB | 2374581 | A1 * | 10/2002 |
| GB | 2 415 163 | | 12/2005 |
| WO | 01/83657 | | 11/2001 |
| WO | 01/83667 | | 11/2001 |
| WO | 01/85898 | | 11/2001 |
| WO | 02/08380 | | 1/2002 |
| WO | WO 02/092455 | A1 * | 10/2002 |
| WO | 2004/031271 | | 4/2004 |

OTHER PUBLICATIONS

Derwent Abstract of EP 0 593 952 published Apr. 27, 1994.

* cited by examiner

*Primary Examiner* — Lorna M Douyon
(74) *Attorney, Agent, or Firm* — Sterne Kessler Goldstein & Fox P.L.L.C.

(57) ABSTRACT

An article comprising a first pouch made of a water-soluble material containing a first solid and/or liquid composition and a second pouch made of a water-soluble material containing a second solid and/or liquid composition characterized in that at least one of the first and second pouches is made from a material which remains substantially intact when immersed in water under a first set of conditions but will readily dissolve or disintegrate when immersed in water under a second set of conditions.

15 Claims, No Drawings

LAUNDRY ARTICLES

FIELD OF THE INVENTION

This invention relates to articles containing two or more enclosed compositions which may be sequentially released. In particular the invention relates to an article useful in laundry treatment which releases compositions at different-stages in the laundry cycle.

BACKGROUND TO THE INVENTION

Cleaning products and fabric care products are available in various forms, such as granular compositions, liquid compositions and tablets. It is also known to put cleaning products and fabric care products in unit dose sachets, which can be water-soluble or water-permeable, to release the product when added to water. Known sachets, for example laundry sachets, may have two compartments, which each comprise different ingredients, typically ingredients which are not compatible with one another. These compartments are typically attached to another and simultaneously release the products.

WO02/08380 discloses an article comprising a first pouch made of a water-reactive material which comprises in its interior:

a) a first solid or liquid composition; and b) a second pouch made of a water-reactive material comprising in its interior a second solid or liquid composition.

In one embodiment the first pouch contains therein a first composition and a second pouch contains therein a second composition. The first pouch is made of a material which releases the first composition significantly earlier than the second pouch releases the second composition. Preferably, the first composition is a builder composition, while the second composition is a fabric care composition, fabric cleaning composition, or hard surface cleaning composition. Such an embodiment preferably employs a first pouch which quickly dissolves and/or ruptures to release the first composition, and a second pouch which dissolves and/or ruptures more slowly to release the second composition.

This arrangement provides especially useful benefits, such as allowing sequential water softening and subsequent cleaning.

The pouches are made from a water-reactive material, i.e. material which either dissolves, ruptures, disperses or disintegrates (or mixtures thereof) upon contact with water, releasing thereby the composition. Preferably, the material is water-soluble.

The first pouch will react in water to release its contents before the second pouch, due to the nature of the construction of the article. To further enhance this sequential release, the first pouch may be more water-soluble than the second pouch. This can for example be achieved by using different type of material for the first pouch than for the second pouch; for example, the first pouch is made of a material having a different type of polymer, a different plasticiser, different levels components in the material, different coating of the film material, different thickness of the film material.

One of the problems associated with such articles is that it is difficult to obtain release of the compositions precisely at pre-determined times.

SUMMARY OF THE INVENTION

According to the present invention there is provided an article comprising a first pouch made of a water-soluble material containing a first solid and/or liquid composition and a second pouch made of a water-soluble material containing a second solid and/or liquid composition characterised in that at least one of said first and second pouches is made from a material which remains substantially intact when immersed in water under a first set of conditions but will readily dissolve or disintegrate when immersed in water under a second set of conditions.

The article of the invention comprises a pouch made of a material which remains intact in water under one set of conditions but is capable of being "triggered" by changing the conditions such that it will readily dissolve or disintegrate. The first and second set of conditions are preferably different stages in a laundry process. The triggered release enables the contents of the pouch to be dispensed at a pre-determined time by appropriate adjustment of the conditions.

The packages are designed so that under their release conditions they will dissolve and/or disperse in the aqueous medium in less than 10 minutes at 25° C., preferably in less than 7 minutes, more preferably in less than 5 minutes, e.g. less than 2 minutes.

In one embodiment the pouch may be made of a material which is insoluble in water in the presence of anionic surfactant but soluble in water in the absence of the anionic surfactant.

In another embodiment the pouch may be made of a material which is insoluble in water at high pH and soluble in water at low pH or vice versa. In a further embodiment the pouch may be made of a material which requires the presence of an active material such as an acid, a ligand or an enzyme to cause disintegration or solubilisation in water.

The change in conditions required to trigger the disintegration/dissolution of the pouch may be the result of change of conditions of a normal laundry cycle e.g. presence or absence of anionic surfactant in the treatment liquor or pH change. Alternatively, the change in conditions may be achieved by the introduction of an activator into the treatment liquor e.g. addition of acid, ligand, enzyme etc. Disintegration/dissolution may also be triggered by a change in ionic strength.

In one embodiment of the invention the first pouch comprises a detergent composition for main wash and the second pouch comprises a fabric conditioning or fabric care composition. The first pouch is made of a material soluble in tap water and the second pouch is made of a material which is insoluble in the main wash liquor but soluble in the rinse water. The second pouch is preferably positioned within the first pouch. The article may be placed in a washing machine with the wash. The first pouch dissolves in the wash water providing the main wash environment and the second pouch remains intact during the main wash. The second pouch dissolves in the rinse water to release the fabric conditioner or fabric care compositions.

In another embodiment the first pouch may comprise a fabric conditioner and the second pouch may comprise a perfume or super-wetter. The second pouch is triggered to release towards the end of the rinse cycle thereby releasing perfume or super-wetter at the time in the cycle when it is most effective.

In a further embodiment, the invention may be used to provide sequential release of cleaning ingredients within a detergent composition, in order to deliver at the stage of the wash process which maximises the effectiveness of the overall composition. For instance, lipase performance may be improved by delaying delivery until after the concentration of wash surfactant is reduced.

The first and second pouches may be attached to each other by any suitable attachment means. In one embodiment they may share a common seam. In another embodiment the pouches are separate with one pouch contained within the other pouch. In another embodiment one pouch may float freely within the other pouch.

Suitable polymeric films which may be used to form the pouches are disclosed in WO02/102955, WO02/102956, WO03/055970 and WO2004/031271.

Preferred water-soluble polymers are those capable of being cast into a film or solid mass and may for example as described in Davidson and Sittig, Water-Soluble Resins, Van Nostrand Reinhold Company, New York (1968). The water-soluble polymer should have proper characteristics, such as strength and pliability, to permit machine handling.

The water-soluble resin film may be formulated so as to remain substantially intact during the main wash cycle of the washing machine operation. Preferably it should also be formulated to completely dissolve in water at the beginning of or during the rinse cycle although this is not essential as the activator may be present for this purpose.

In the context of the present invention, "substantially intact" means that the film may dissolve or disperse partially but the contents thereof remain wholly within the film.

Preferred water-soluble resins include PVOH, cellulose ethers, polyethylene oxide (hereinafter referred to as "PEO"), starch, polyvinylpyrrolidone (hereinafter referred to as "PVP"), polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose, and copolymers thereof. The film may comprise a single polymer or blends of different polymers.

All of the above polymers include the aforementioned polymer classes whether as single polymers or as copolymers formed of monomer units or as copolymers formed of monomer units derived from the specified class or as copolymers wherein those monomer units are copolymerised with one or more comonomer units.

Lower molecular weight water-soluble, PVOH film-forming resins are particularly preferred.

PVP films are advantageous in that they are clear, glossy, and reasonably hard at low humidity, although it is preferred that a water-insensitive modifier, such as 10% of an arylsulfonamide-formaldehyde resin, is incorporated into PVP films to reduce tackiness at higher humidity.

Preferred water-soluble films may also be prepared from polyethylene oxide (PEO) resins by standard moulding techniques such as calendering, casting, extrusion, and other conventional techniques. The polyethylene oxide films may be clear or opaque, and are inherently flexible, tough, and resistant to most oils and greases. These polyethylene oxide resin films provide better solubility than other water-soluble plastics without sacrificing strength or toughness. The excellent ability to lay flat, stiffness, and sealability of water-soluble polyethylene oxide films make for good machine handling characteristics.

PVOH Films

Generally, preferred water-soluble, PVOH film-forming polymers should have relatively low average molecular weight and low levels of hydrolysis in water. Polyvinyl alcohols preferred for use therein have an average molecular weight between 1,000 and 300,000, preferably between 2,000 and 100,000, most preferably between 2,000 and 75,000.

Hydrolysis, or alcoholysis, is defined as the percent completion of the reaction where acetate groups on the resin are substituted with hydroxyl, —OH, groups. A hydrolysis range of from 60-99% of PVOH film-forming resin is preferred. For the first or outer pouch the film preferably has a range of hydrolysis of from about 80 to 88%. For the delayed (triggered) release film forming the other pouch the range of hydrolysis is preferably in the range 88 to 99%.

As used in this application, the term "PVOH" includes polyvinyl acetate compounds with levels of hydrolysis disclosed herein.

PVOH can be made by the polymerisation of vinyl acetate, followed by hydrolysis, conveniently by reaction with sodium hydroxide. However, the resulting film has a highly symmetrical, hydrogen-bonded structure and is not readily soluble in cold water. PVOH films which are suitable for the formation of water-soluble packages are typically polymers produced from copolymerisation of vinyl acetate and another comonomer which contains a carboxylic function. Examples of such comonomers include monocarboxylates, such as acrylic acid, and dicarboxylates, such as itaconic acid, which may be present during polymerisation as esters. Alternatively, the anhydride of maleic acid may be used as the copolymer. The inclusion of the comonomer reduces the symmetry of and degree of hydrogen bonding in the final film and renders the film soluble even in cold water.

Suitable PVOH films for use in a package according to the invention are commercially available and described, for example, in EP-B-0291198. PVOH films for use in a package according to the invention can be made by the copolymerisation of vinyl acetate and a carboxylate-containing monomer (for example acrylic, maleic or itaconic acid or acid ester), followed by partial hydrolysis with sodium hydroxide.

Cross-Linking Agent

In order to provide a water-soluble package which maintains integrity and structure during the wash cycle but which dissolves or disperses fully in the rinse cycle, it has been found advantageous for the water-soluble film to comprise a cross-linking agent.

Particularly suitable cross-linking agents include formaldehyde; polyesters; epoxides; isocyanates; vinyl esters; urethanes; polyimides; acrylics with hydroxyl, carboxylic, isocyanate or activated ester groups; bis(methacryloxypropyl) tetramethylsiloxane (styrenes, methylmethacrylates); n-diazopyruvates; phenylboronic acids; cis-platin; divinylbenzene (styrenes, double bonds); polyamides; dialdehydes; triallyl cyanurates; N-(-2-ethanesulfonylethyl)pyridinium halides; tetraalkyltitanates; mixtures of titanates and borates or zirconates; polyvalent ions of Cr, Zr, Ti; dialdehydes, diketones; alcohol complexes of organotitanates, zircoates and borates and copper (II) complexes.

Most preferred as the cross-linking agent is boric acid or its salt form, e.g. sodium borate.

The level of cross-linking agent, if present, is from about 0.05% to 9% by weight of the film, more preferably 1% to 6%, most preferably about 1.5% to 5% by weight. The upper range will, of course, result in more cross-linking and a slower rate of dissolution or dispersion of the film in the rinse cycle.

Functionally, it is believed that the cross-linking agent reduces the solubility of the film polymer by increasing its effective molecular weight such that the polymer gels under the alkaline wash conditions. Generally the effective molecular weight of the gel state is about $2\times10^8$ g/mole which gives a gel-product viscosity of about 100,000 mPa·s.

For PVOH films, the preferred cross-linking agent is a metalloid oxide such as borate, tellurate, arsenate, and precursors thereof. Other known cross-linkers are selected from a vanadyl ion, a titanium ion in the plus three valence state, or a permanganate ion (disclosed in U.S. Pat. No. 3,518,242). Other cross-linkers are given in the book: Polyvinylalcohol —Properties and applications, Chapter 9 by C. A. Finch (John Wiley & Sons, New York, 1973). The cross-linking agent can be present in the film itself and/or in the wash solution.

Additional Protective Layers

A protective layer, such as PTFE, may be present between the film polymer and the composition in the pouch. In such a case, it is possible for the composition to comprise higher levels of water. Suitable water-soluble films coated with PTFE are disclosed in U.S. Pat. No. 4,416,791.

Such coated films are capable of maintaining structure and integrity even if the contents comprise a composition having a level of water of 30% by weight or more, even 50% by weight or more.

Plasticiser

The film preferably comprises plasticiser.

One or more plasticisers may independently be incorporated in the film and in the liquid composition. However, it is very much preferred for the identity of the plasticiser in the film and in the liquid composition to be substantially the same.

The plasticiser influences the way the polymer chains react to external factors such as compression and extensional forces, temperature and mechanical shock by controlling the way that the chains distort/realign as a consequences of these intrusions and, their propensity to revert or recover to their former state. The key feature of the plasticiser is that it is highly compatible with the film. Typically it is hydrophilic in nature.

The preferred plasticiser will depend on the nature of the film in question.

Generally, plasticisers suitable for use with PVOH-based films have —OH groups in common with the —$CH_2$—CH(OH)—$CH_2$—CH(OH)— polymer chain of the film polymer. Water itself is a suitable plasticiser for PVOH films but other common plasticisers include polyhydroxy compounds, such as glycerol, trimethylolpropane, diethylene glycol, triethylene glycol, dipropylene glycol; starches, such as starch ether, esterificated starch, oxidized starch and starches from potato, tapioca and wheat; cellulosics/carbohydrates, such as amylopectin, dextrin carboxymethylcelluose and pectin.

The preferred amount of plasticiser is from 0.001% to 10%, preferably from 0.005% to 4% by weight of the liquid contents of the water soluble package.

Encapsulation Methods

Any reference herein to filling refers to complete filling and also partial filling whereby some air or other gas is also trapped in the sealed pouch.

(a) Horizontal Form-Fill-Seal

Water-soluble packages based on PVOH can be made according to any of the horizontal form-fill-seal methods described in any of WO-A-00/55044, WO-A-00/55045, WO-A-00/55046, WO-A -00/55068, WO-A-00/55069 and WO-A-00/55415.

By way of example, a thermoforming process is now described where a number of packages according to the invention are produced from two sheets of water-soluble material. In this regard recesses are formed in the film sheet using a forming die having a plurality of cavities with dimensions corresponding generally to the dimensions of the packages to be produced. Further, a single heating plate is used for thermoforming the film for all the cavities, and in the same way a single sealing plate is described.

A first sheet of PVOH film is drawn over a forming die so that the film is placed over the plurality of forming cavities in the die. In this example each cavity is generally dome shape having a round edge, the edges of the cavities further being radiussed to remove any sharp edges which might damage the film during the forming or sealing steps of the process. Each cavity further includes a raised surrounding flange. In order to maximise package strength; the film is delivered to the forming die in a crease free form and with minimum tension. In the forming step, the film is heated to 100 to 120° C., preferably approximately 110° C., for up to 5 seconds, preferably approximately 700 micro seconds. A heating plate is used to heat the film, which plate is positioned to superpose the forming die. During this preheating step, a vacuum of 50 kPa is pulled through the pre-heating plate to ensure intimate contact between the film and the pre-heating plate, this intimate contact ensuring that the film is heated evenly and uniformly (the extent of the vacuum is dependant of the thermoforming conditions and the type of film used, however in the present context a vacuum of less than 0.6 kPa was found to be suitable). Non-uniform heating results in a formed package having weak spots. In addition to the vacuum, it is possible to blow air against the film to force it into intimate contact with the preheating plate.

The thermoformed film is moulded into the cavities blowing the film off the heating plate and/or by sucking the film into the cavities thus forming a plurality of recesses in the film which, once formed, are retained in their thermoformed orientation by the application of a vacuum through the walls of the cavities. This vacuum is maintained at least until the packages are sealed. Once the recesses are formed and held in position by the vacuum, a liquid composition according to the invention is added to each of the recesses. A second sheet of polyvinyl alcohol film is then superposed on the first sheet across the filled recesses and heat-sealed thereto using a sealing plate. In this case the heat sealing plate, which is generally flat, operates at a temperature of about 140 to 160° C., and contacts the films for 1 to 2 seconds and with a force of 8 to 30 $kg/cm^2$, preferably 10 to 20 $kg/cm^2$. The raised flanges surrounding each cavity ensure that the films are sealed together along the flange to form a continuous seal. The radiussed edge of each cavity is at least partly formed by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

During the forming, filling and sealing steps of the process, the relative humidity of the atmosphere is controlled to ca. 50% humidity. This is done to maintain the heat sealing characteristics of the film. When handling thinner films, it may be necessary to reduce the relative humidity to ensure that the films have a relatively low degree of plasticisation and are therefore stiffer and easier to handle.

(b) Vertical Form-Fill-Seal

In the vertical form-fill-seal (VFFS) technique, a continuous tube of flexible plastics film is extruded. It is sealed, preferably by heat or ultrasonic sealing, at the bottom, filled with the liquid composition, sealed again above the liquid film and then removed from the continuous tube, e.g. by cutting.

Encapsulation methods for other water-soluble films such as based on PVP or PEO will be known to those skilled in the art.

Unit Dose Volume

The amount of the substantially non-aqueous liquid product in each pouch may for example be from 0.5 ml to 100 ml, e.g. from 1 ml to 30 ml, preferably from 1.5 ml to 25 ml, more preferably from 2 ml to 15 ml.

Activator

In one embodiment of the invention there is provided a fabric treatment kit comprising the two pouches and an activator which causes and/or accelerates the disintegration of one of the pouches.

The activator is selected for its compatibility with the film forming the pouch.

For instance, where a film is formulated so as to disintegrate in response to changes in the pH the wash environment, a pH-accentuating activator may be provided. Alternatively, for a film which disintegrates in response to changes in the ionic strength of the rinse liquor, the activator is formulated so as to change the ionic strength of the liquor more dramatically. A further alternative is, for instance, where the film comprises active groups which cause the film to disintegrate in the presence of certain enzymes. In such a case, the activator comprises the relevant enzymes.

The activator is provided within the kit separately from the pouches. That is, the activator and pouches are discrete from each other.

Whereas the pouches are typically dosed directly into the drum of the washing machine, the activator is preferably dosed into the rinse compartment of the dispenser drawer of the washing machine.

Thus, the activator does not normally enter the rinse liquor until the rinse cycle commences.

The activator may be in the form of a solid or liquid material. If solid it can, for example, be granulated, powdered, tabletted, a foam or in the form of a bar or block. It is particularly preferred that the activator is in the form of a solid block or tablet as this can advantageously be constructed either as a single use activator where all of the block or tablet disintegrates and is delivered to the rinse liquor in one laundry cycle or as a multiple use activator where only part of the activator block or tablet disintegrates and is delivered to the rinse liquor.

A typical activator comprises one or more of the following active materials which individually or in combination cause and/or accelerate the disintegration of the water-soluble package during the rinse cycle:

ligands
acids
enzymes

Ligands

A ligand may be present which bonds with functional groups on the polymeric film and causes the film to become soluble during the rinse cycle.

The ligand is preferably a bi- or polydentate ligand. Suitable ligands include 1,2-ethanediol, glycolic acid, lactic acid, sucrose, poly(vinylalcohol), oxalic acid, glycerol, citric acid or combinations thereof.

Where the active ingredient of an activator comprises a ligand, it is especially preferred that the polymeric film is cross-linked, e.g. with a metalloid oxide cross-linking agent.

In a preferred embodiment, the activator is a solid material comprising a ligand in an amount from to 0.5 to 40% by weight of the total weight of the activator, more preferably 1 to 20% by weight, most preferably 1 to 10% by weight.

Acids

The pH of the wash environment is typically more acidic during the rinse cycle than the wash cycle, and it is desirable that the film is responsive to such a change.

Thus, the active ingredient may be an acid which reduces the pH of the rinse liquor and accentuates the pH drop from the wash cycle to the rinse cycle so as to accelerate disintegration of acid-sensitive water-soluble packages.

It is particularly preferred that where the active ingredient of the activator is an acid, the water-soluble polymeric film comprises functional groups which provide the film with significantly increased solubility when the pH is reduced from the wash cycle to the rinse cycle.

Suitable functional groups which significantly increase solubility of the polymeric film at lower pH values include, for example, amides, orthoesters, acetals, hemi-acetals and primary, secondary and tertiary amines.

Polymeric films complexed with cross-linking agents, such as described above, are also found to be particularly susceptible to a pH reduction of the environment and thus are especially suited for use with an acid-based activator.

The acid may be an inorganic or organic acid. Suitable acids include, for instance, sodium hydrogen sulphate, hydroxycitric acid, sodium hydrogen carbonate, potassium hydrogen tartrate, potassium dihydrogen citrate, sodium hydrogen diglyconate, hydrochloric acid, methane sulphonic acid, toluene sulphonic acid, potassium tetroxalate and short chain organic acids such as propionic and acetic acid.

In a preferred embodiment, the activator is a solid material comprising an acid in an amount from to 2 to 60% by weight of the total weight of the activator, more preferably 2 to 30% by weight, most preferably 2 to 15% by weight.

Enzymes

Enzymes are also suitable as the active ingredient in an activator.

Particularly preferred enzymes are those which transform the functional groups on the polymeric film by for example, hydrolysis, oxidation and/or reduction. To this end, mixtures of enzymes may be employed in the activator.

For instance, enzymes such as lipase BCC can increase the rate of hydrolysis of ester groups within a water-soluble polymeric film and esterases and proteases hydrolyse acyl groups within a fatty acylated PVOH film.

Nitrilase enzymes can be used to hydrolyze cyano groups to carboxylic acid groups thus rendering soluble the water insoluble cyano-containing polymeric film.

For example, acrylonitrile homo- or co-polymers with vinyl acetate are insoluble in water but the use of nitrilase enzymes causes hydrolysis of the nitrile functions to carboxylic acids rendering the polymer soluble in the aqueous media.

Other suitable enzymes are those isolated from *Rhodococcus* sp., and *Rhodococcus butanica.*

Where the active ingredient in an activator is an enzyme, it is preferred that the activator is a porous solid support such as alumina or zeolite containing the immobilized enzyme, which is released with pH buffers during the rinse to hydrolyze the esters within the polymeric film.

The activator may comprise a single active material or a combination of active materials, e.g. an acid and a ligand.

Optional Activator Ingredients

The activator may include ingredients to assist formation of the activator in the desired form, i.e. liquid or solid.

For instance, a solid tablet preferably also contains glycerol, citric acid, water and is formed by the standard compression or moulding techniques used for forming a detergent tablet.

One of the pouches may contain a detergent composition for a main wash. The composition may be in solid or liquid form or a mixture thereof. Suitable detergent compositions are well known in the art.

One of the pouches may contain a rinse conditioning composition which is substantially non-aqueous so as to be compatible with the water-soluble polymeric film.

In the context of the present invention, "substantially non-aqueous" means that the level of water or other aqueous components in the rinse conditioner composition is 10% by weight or less of the total weight of the rinse conditioner composition, more preferably 5% or less by weight, most preferably 3% or less by weight.

However, if a protective layer is present between the film and the rinse conditioner composition, it is possible for the rinse conditioning composition to be a conventional aqueous rinse conditioner, comprising more than 10% by weight of water.

If the composition is substantially non-aqueous it may be in any suitable form, such as substantially non-aqueous concentrated melts, concentrated emulsions and microemulsions.

For the purposes of the present invention, a substantially non-aqueous concentrated melts is defined as a fabric conditioning composition present in solid form, such as particles, at a specified temperature, the solid being suspended in an oil matrix and containing less than 10 wt %, preferably less than 5 wt % of water.

A substantially non-aqueous concentrated rinse conditioner emulsion is defined as a mixture of a quaternary ammonium softening material, an oil and water comprising more than 10 wt % of the quaternary ammonium material and less than 10 wt % of water.

A substantially non-aqueous microemulsion is defined as a composition comprising less than 10% by weight water, wherein the composition is clear, isotropic and thermodynamically stable across a range of temperatures.

Rinse Conditioning Compositions

The following conventional ingredients are optionally present in the rinse conditioning compositions.

Quaternary Ammonium Fabric Softening Material

The quaternary ammonium fabric softening material generally comprises one or more fatty hydrocarbyl chains attached to a nitrogen headgroup.

Preferably, the average length of the hydrocarbyl chain is at least $C_{14}$, more preferably at least $C_{16}$. Most preferably at least half of the chains have a length of $C_{18}$.

It is generally preferred that the hydrocarbyl chain is predominantly linear.

It is especially preferred that the softening material comprises a compound having two $C_{12-18}$ alkyl or alkenyl groups connected to the nitrogen head group via at least one ester link. It is more preferred if the quaternary ammonium material has two ester links present.

A first group of preferred ester-linked cationic surfactant materials for use in the invention is represented by formula (I):

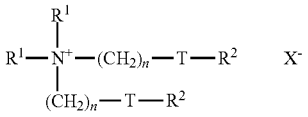

wherein each $R^1$ group is independently selected from $C_{1-4}$ alkyl or $C_{2-4}$ alkenyl groups; and wherein each $R^2$ group is independently selected from $C_{8-28}$ alkyl or alkenyl groups;

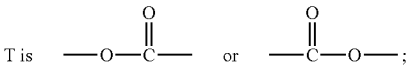

$X^-$ is any anion compatible with the cationic surfactant, such as halides or alkyl sulphates, e.g. chloride, methyl sulphate or ethyl sulphate and n is 0 or an integer from 1-5.

A second preferred softening material for use in the invention is represented by formula (II):

(Formula II)

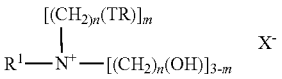

wherein each R is independently selected from a $C_{5-35}$ alkyl or alkenyl group, $R^1$ represents a $C_{1-4}$ alkyl or hydroxyalkyl group or a $C_{2-4}$ alkenyl group, m is 1, 2 or 3 and denotes the number of moieties to which it refers that pend directly from the N atom and T, n and $X^-$ are as defined above.

Especially preferred materials within this formula are dialkenyl esters of triethanol ammonium methyl sulphate and N-N-di(tallowoyloxy ethyl)N,N-dimethyl ammonium chloride. Commercial examples of compounds within this formula are Tetranyl® AOT-1 (di-oleic ester of triethanol ammonium methyl sulphate 80% active), AO-1 (di-oleic ester of triethanol ammonium methyl sulphate 90% active), Tetranyl® AHT-1 (di-hardened tallowyl ester of triethanol ammonium methyl sulphate 85% active), L1/90 (partially hardened tallow ester of triethanol ammonium methyl sulphate 90% active), L5/90 (palm ester of triethanol ammonium methyl sulphate 90% active (supplied by Kao corporation); Rewoquat WE15 ($C_{10}$-$C_{20}$ and $C_{16}$-$C_{18}$ unsaturated fatty acid reaction products with triethanolamine dimethyl sulphate quaternised 90% active), WE18 and WE20 (both are partially hardened tallow ester of triethanol ammonium methyl sulphate 90% active), ex Goldschmidt Corporation; and Stepantex VK-90 (partially hardened tallow ester of triethanol ammonium methyl sulphate 90% active), ex Stepan Company.

A third preferred type of quaternary ammonium material is represented by formula (III):

Formula (III)

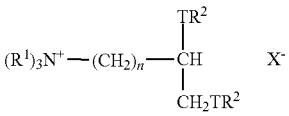

wherein $R^1$, $R^2$, n, T and $X^-$ are as defined above.

Preferred materials of this class such as 1,2 bis[tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A fourth preferred type of quaternary ammonium material is represented by formula (IV):

Formula (IV)

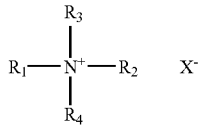

where $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Examples of compounds within this formula include di(tallow alkyl)dimethyl ammonium chloride, di(tallow alkyl)dimethyl ammonium methyl sulphate, dihexadecyl dimethyl ammonium chloride, di(hardened tallow alkyl)dimethyl ammonium chloride, dioctadecyl dimethyl ammonium chloride and di(coconut alkyl)dimethyl ammonium chloride.

The softening material is preferably present in an amount from 2 to 60% by weight of the active ingredient, more preferably 2.5 to 30% by weight, most preferably 3-25% by weight, based on the total weight of the composition.

Preferred softening materials are substantially water insoluble.

'Substantially water insoluble' surfactant compounds in the context of this invention are defined as compounds having a solubility less than $1\times10^{-3}$ wt % in demineralised water at 20° C. Preferably the cationic surfactants have a solubility less than $1\times10^{-4}$. Most preferably the cationic surfactants have a solubility at 20° C. in demineralised water from $1\times10^{-8}$ to $1\times10^{-6}$ wt %.

Oily Sugar Derivatives

The rinse conditioner compositions may comprise an oily sugar derivative.

The oily sugar derivative is a liquid or soft solid derivative of a cyclic polyol or of a reduced saccharide, said derivative resulting from 35 to 100% of the hydroxyl groups in said polyol or in said saccharide being esterified or etherified. The derivative has two or more ester or ether groups independently attached to a $C_8$-$C_{22}$ alkyl or alkenyl chain.

The rinse conditioner composition may comprise from 0.5%-90 wt % of the oily sugar derivatives, more preferably 5-80 wt %, most preferably 10-60 wt %, based on the total weight of the composition.

Formulation and Dispersion Aids

The formulation aid is substantially non-aqueous and comprises one or more of the following components:

nonionic stabilising agents;
polymeric stabilisers;
single long hydrocarbyl chain cationic surfactants;
long chain fatty alcohols or acids;
short chain alcohols or oils; and
inorganic and/or organic electrolytes Nonionic Stabilising Agents The nonionic stabilising agents suitable for use in the rinse conditioner compositions include any of the alkoxylated materials of the particular type described hereinafter can be used as the nonionic surfactant.

Substantially water-soluble surfactants of the general formula:

$$R—Y—(C_2H_4O)z\text{-}C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is at least about 8, preferably at least about 10 or 11.

Z denotes the average numbers of alkoxy moieties per molecule. Especially preferred nonionic stabilising agents are alkoxylated nonionic fatty alcohols, such as $C_{10}$-$C_{22}$ alkyl/alkenyl fatty alcohols alkoxylated with 3-30, more preferably 5-25, most preferably 10-20 alkoxy moieties per molecule. The fatty alcohols may be alkoxylated with ethylene oxide, propylene oxide or ethylene oxide/propylene oxide mixtures.

Polymeric Stabilisers

Suitable polymeric stabilisers includes compounds having at least 2% by weight of water-soluble groups either within the main polymer backbone or pendant thereto Examples of polymeric stabilisers within this class include PVA; polylactones such as polycaprolactone and polylactide; methyl cellulose; derivativised starches; derivatives of cellulose; and cationic polymers such as Guar Gum.

If present, it is desirable to incorporate such polymers at a level of from 0.01 to 5%, more preferable 0.05 to 3.5%, most preferably from 1 to 2% by weight of the polymer based on the total weight of the composition.

Single Long Hydrocarbyl Chain Cationic Surfactants

The compositions of the invention optionally contain a single long hydrocarbyl chain cationic surfactant.

The single long hydrocarbyl chain cationic surfactant are particularly suitable for use in emulsions since they can be employed in the formulation to aid the dispersion characteristics of the emulsion and/or to emulsify the composition, in order to form a macroemulsion having oil droplets which are smaller than those in macroemulsion compositions comprising the cationic fabric softening agent alone.

The single long chain cationic surfactant is preferably a quaternary ammonium compound comprising a hydrocarbyl chain having 8 to 40 carbon atom, more preferably 8 to 30, most preferably 12 to 25 carbon atoms (e.g. quaternary ammonium compounds comprising a $C_{10-18}$ hydrocarbyl chain are especially preferred).

Examples of commercially available single long hydrocarbyl chain cationic surfactants which may be used in the compositions of the invention include; ETHOQUAD® 0/12 (oleylbis(2-hydroxyethyl)methylammonium chloride); ETHOQUAD® C12 (cocobis(2-hydroxyethyl)methyl ammonium chloride) and ETHOQUAD® C25 (polyoxyethylene(15)cocomethylammonium chloride), all ex Akzo Nobel; SERVAMINE KAC®, (cocotrimethylammonium methosulphate), ex Condea; REWOQUAT® CPEM, (coconutalkylpentaethoxymethylammonium methosulphate), ex Degussa; cetyltrimethylammonium chloride (25% solution supplied by Aldrich); RADIAQUAT® 6460, (coconut oil trimethylammonium chloride), ex Fina Chemicals; NORAMIUM® MC50, (oleyltrimethylammonium chloride), ex Elf Atochem.

The single long hydrocarbyl chain cationic surfactant is preferably present in an amount from 0 to 5% by weight, more preferably 0.01 to 3% by weight, most preferably 0.5 to 2.5% by weight, based on the total weight of the composition.

Long Chain Fatty Alcohols, Acids or Oils

The formulation aid may further be selected from fatty alcohols, acids or oils, for example C8 to C24 alkyl or alkenyl monocarboxylic acids, alcohols or polymers thereof and $C_8$ to $C_{35}$ oils. Preferably saturated fatty acids or alcohols are used, in particular, hardened tallow $C_{16}$ to $C_{18}$ fatty acids.

Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated and superconcentrated compositions may comprise from 0.5 to 20% by weight of fatty acid, more preferably 1% to 10% by weight.

Suitable fatty acids include stearic acid (PRIFAC 2980), myristic acid (PRIFAC 2940), lauric acid (PRIFAC 2920), palmitic acid (PRIFAC 2960), erucic acid (PRIFAC 2990), sunflower fatty acid (PRIFAC 7960), tallow acid (PRIFAC 7920), soybean fatty acid (PRIFAC 7951) all ex Unichema; azelaic acid (EMEROX 1110) ex Henkel.

The fatty acid may also act as a co-softener in the rinse conditioner composition.

The formulation aid may comprise a long chain oil. The oil may be a mineral oil, an ester oil, a silicone oil and/or natural oils such as vegetable or essential oils. However, ester oils or mineral oils are preferred.

The ester oils are preferably hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 8, and that at least one of the hydrocarbon chains has 12 or more carbon atoms.

Suitable ester oils include saturated ester oils, such as the PRIOLUBES (ex. Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable. It is preferred that the viscosity of the ester oil is from 0.002 to 0.4 Pa·S (2 to 400 cps) at a temperature of 25° C. at 106 $s^{-1}$, measured using a Haake rotoviscometer NV1, and that the density of the mineral oil is from 0.8 to 0.9 $g \cdot cm^{-3}$ at 25° C.

Suitable mineral oils include branched or straight chain hydrocarbons (e.g. paraffins) having 8 to 35, more preferably 9 to 20 carbon atoms in the hydrocarbon chain.

Preferred mineral oils include the Marcol technical range of oils (ex Esso) although particularly preferred is the Sirius range (ex Silkolene) or Semtol (ex Witco Corp.). The molecular weight of the mineral oil is typically within the range 100 to 400.

One or more oils of any of the above mentioned types may be used.

It is believed that the oil provides excellent perfume delivery to the cloth and also increases perfume longevity upon storage of the composition.

The oil may be present in an amount from 0.1 to 40% by weight, more preferably 0.2-20%, by weight, most preferably 0.5-15% by weight based on the total weight of the composition.

Short Chain Alcohols

The formulation aid may comprise a short chain alcohol. Preferred are low molecular weight alcohols having a molecular weight of preferably 180 or less. The alcohol may be mono or polyhydric.

The presence of the lower molecular weight alcohol helps improve physical stability upon storage by lowering the viscosity to a more desired level and also assists the formation of the micro-emulsion. Examples of suitable alcohols include ethanol, isopropanol, n-propanol, dipropylene glycol, t-butyl alcohol, hexylene glycol, and glycerol.

The alcohol is preferably present in an amount from 0.1% to 40% by weight, more preferably from 0.2% to 35%, most preferably 0.5 to 20% by weight based on the total weight of the composition.

Inorganic and/or Organic Electrolytes

The fabric softening composition optionally comprises an electrolyte.

The electrolyte may be an inorganic or organic electrolyte.

Preferably the electrolyte is present in an amount from 0.001 to 1.5%, more preferably 0.01 to 1%, most preferably 0.02 to 0.7% by weight based on the total weight of the composition.

Suitable inorganic electrolytes include sodium sulphate, sodium chloride, calcium(II) chloride, magnesium(II) chloride, potassium sulphate and potassium chloride.

Suitable organic electrolytes include sodium acetate, potassium acetate, sodium citrate, potassium citrate and sodium benzoate.

The electrolyte improves viscosity control (especially viscosity reduction) of the compositions and assists dispersion of the composition.

Co-Active Softening Surfactants

Co-active softening surfactants for the cationic surfactant may also be incorporated in an amount from 0.01 to 20% by weight, more preferably 0.05 to 10%, based on the total weight of the composition. Preferred co-active softening surfactants are fatty amines, fatty acids and fatty N-oxides.

Perfume

The perfume may be any perfume conventionally used in fabric softening compositions, although it is particularly desirable that the perfume is lipophilic. It is especially preferred that the perfume has a solubility in water of no more than 10 g, preferably no more than 0.5 g, most preferably no more than 0.3 g per litre at 20° C.

Typical perfume ingredients suitable for use in the composition are as disclosed in 'Perfume and Flavour Chemicals' by Steffen Arctander (published by the author, Library of Congress catalogue card no. 75-91398).

The perfume is preferably present at a level from 0.01 to 20%, more preferably from 0.05 to 17%, most preferably from 1 to 10%, e.g. 2 to 6% by weight based on the total weight of the composition. In one embodiment the perfume may be in one pouch and fabric conditioner composition or detergent present in the other pouch. At least a portion of the perfume may be present in the form of microcapsules.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, germicides, fungicides, anti-corrosion agents, drape imparting agents, anti-static agents, ironing aids and dyes.

The rinse conditioner is substantially, and preferably entirely, free of anionic detergent surfactants conventionally used as an active cleaning ingredient in a main wash detergent product.

Main Wash Detergents

Suitable main wash detergents for use in the invention are well known in the art and include liquid detergent compositions, granular detergent powders and suspensions.

When a liquid detergent composition is used, it is preferred that the composition is essentially non-aqueous. However, compositions may be used which contain substantial amounts of water, provided that this water is in a form where its chemical activity is reduced (e.g. as water of crystallisation or in combination with a solvent such that its vapour pressure is reduced) such that the soluble film does not dissolve prematurely.

One example of a liquid detergent composition useful in the inventions is as follows:

| Raw Material | Level (weight percent of total) |
|---|---|
| Nonionic Surfactant (alcohol ethoxylate) | 20.00 |
| Linear Dodecylbenzene Sulphonic Acid | 20.00 |
| Fatty Acid | 17.00 |
| Monopropylene glycol | 22.35 |
| Monoethanolamine | 9.65 |
| Water, perfume, minor ingredients | 11.00 |

Another example of a liquid detergent composition useful in the invention is as follows:

| Raw Material | Level (weight percent of total) |
|---|---|
| Nonionic Surfactant | 60.00 |
| Polyethylene glycol | 27.15 |
| Monopropylene glycol | 5.00 |
| Antifoam 3522/SPE* premix | ~2.00 |
| Hydroxypropylcellulose polymer | 1.35 |
| Perfume | ~1.0 |
| Dye Transfer Inhibitor Polymer | 0.5 |
| Protease enzyme (Relase) | 1.0 |
| Water | 2.0-3.0 |

*modified surfactant

An example of a granular detergent powder suitable for use in the invention is as follows:

| Base Powder | |
|---|---|
| Linear Dodecylbenzene Sulphonic Acid (Sodium salt) | 8.8% |
| Alcohol ethoxylate (C12-C13 EO) | 7.0% |
| C16-C18 Carboxylic acid | 1.0% |
| Zeolite | 29.6% |
| Anhydrous Sodium Carbonate | 10.5% |
| Moisture, Salts, Minors | 4.1% |

(All above in a granulated Base Powder)

| Post - dosed ingredients | |
|---|---|
| Sodium Percarbonate | 18% |
| Tetracetyl ethylenediamine | 3.5% |
| Sodium Disilicate | 5.5% |
| Sodium Citrate | 2.0% |
| Fluorescer, antifoam, speckles, enzyme, fragrance, minors | 10.0% |

The invention will be illustrated by the following Example.

EXAMPLE

This Example illustrates a twin compartment unit dose sachet comprised of an inner sachet composed of a hydrophobically modified (anionic sensitive) Polyvinyl Alcohol (HM-PVOH) film, prepared in accordance with Example 1 of WO2004/031271. This film has an extremely low solubility in wash detergent (anionic containing) liquor. On removal of the wash detergent the machine refills with fresh water (anionic absent) water and the solubility of the film is much higher in water alone and as such the film solubilises. Standard PVOH is typically used in the production of Persil capsules and Comfort Pearls. This film has a high solubility in water alone and is unaffected by the presence of anionic.

Construction of the 'Triggered' Sachet (Invention)

A HM-PVOH sachet was constructed that contained 5 ml of perfume.

The sachet comprised of two 90 micron films of HM-PVOH welded along 3 edges, filled with perfume and welded along the final edge. This sachet was then sealed inside another sachet of equal proportions 50 mm×30 mm to produce a twin walled HM-PVOH sachet.

The outer sachet was constructed from two films of standard, 80 micron thick, PVOH commercially available under the trade name Mowiol 10-98 from Kuraray Specialities Europe. These films were welded along 3 edges and the perfume 'triggered' sachet was placed inside. The sachet was then filled with unperfumed and undyed 'Tide' washing powder at a level of 100 grams. The final edge was then sealed resulting in a single walled sachet approximately 200 mm×80 mm. The presence of the 'Tide' powder immediately around the triggered sachet means that when the washing machine is filling with water for the wash phase and the outer sachet solubilised the triggered sachet is exposed to a very high localised concentration of detergent and will not dissolve.

Construction of the Non-Triggered Sachet (Comparative)

The non-triggered sachet was constructed in exactly the same way as the triggered sachet with the exception being that the inner (perfume containing) sachet was composed of standard PVOH.

Testing

A 3 kg 'terry towel' ballast load was placed in a top loading Whirlpool washing machine (US). The sachets were added to the ballast load. A standard 10 minutes wash programme was selected and the warm wash-cold rinse, option selected. The machine was allowed to run its cycle. On completion of the cycle the ballast load was removed and then placed in a 'Miele' tumble dryer. The 'normal dry' option was selected. On completion of the machine cycle the ballast load was removed and placed into a basket. This procedure was run simultaneously in two machines for the triggered and untriggered sachets. The treated loads were placed in separate baskets and five people/panellists were selected at random to smell the baskets and express a preference based on perfume intensity. All five people selected the triggered sachet basket.

I claim:

1. A kit comprising:

an article including a first pouch and a second pouch each made of a flexible polymeric film that is water-soluble under appropriate conditions, the first pouch containing a first solid and/or liquid composition, and the second pouch containing a second solid and/or liquid composition; and an activator material, wherein the activator material is at least one of an acid, a ligand and an enzyme, wherein the polymeric film of the first pouch is more soluble in water in the presence of an activator material than the polymeric film of the first pouch would be in the absence of the activator material, wherein the polymeric film of the first pouch remains substantially intact when immersed in water under a first set of conditions but will readily dissolve or disintegrate when immersed in water under a second set of conditions, wherein the polymeric film of the second pouch will readily dissolve or disintegrate in water under the first set of conditions, wherein the first set of conditions is the absence of the activator material in water at an early stage in a rinse cycle in a wash process, and the second set of conditions is the presence of the activator material in water at a later stage of the rinse cycle in the wash process, and wherein the activator material is separate and discrete from the article comprising the first and second pouches.

2. A kit as claimed in claim 1, wherein the wash process is a laundry process, and wherein the first set of conditions is the absence of the activator material in water at the early stage of the rinse cycle of the laundry process, and the second set of conditions is the presence of the activator material in water at the later stage of the rinse cycle, and wherein the activator material is formulated so as to change the ionic strength of rinse water in the rinse cycle of the laundry process such that the polymeric film of the first pouch is more soluble in the rinse water in the presence of the activator material than the polymeric film of the first pouch would be in the absence of the activator material.

3. A kit as claimed in claim 1, wherein the polymeric film of the first pouch is insoluble in water in the presence of anionic surfactant but soluble in water in the absence of anionic surfactant.

4. A kit as claimed in claim 1, wherein the wash process is a laundry process, and wherein the first set of conditions is the absence of the activator material in water at the early stage of the rinse cycle of the laundry process, and the second set of conditions is the presence of the activator material in water at the later stage of the rinse cycle, and wherein the polymeric film of the first pouch is insoluble in water at high pH and soluble in water at low pH, and wherein the activator material is an acid which reduces the pH of rinse water in the rinse cycle of the laundry process and accentuates the pH drop from a wash cycle to the rinse cycle of the laundry process so as to accelerate disintegration of the polymeric film of the first pouch in the rinse water.

5. A kit as claimed in claim 1, wherein the polymeric film of the first pouch is insoluble in water in absence of the activator material and soluble in water in the presence of the activator material.

6. A kit as claimed in claim 1 in which the first pouch is positioned within the second pouch.

7. A kit as claimed in claim 1, wherein the polymeric film of the second pouch is made of polyvinyl alcohol film.

8. A kit as claimed in claim 1, wherein the polymeric film of the first pouch comprises a polyvinyl alcohol film.

9. A kit as claimed in claim 1, wherein a protective layer made of polytetrafluoroethylene (PTFE) is disposed between the polymeric film of at least one of the first and second pouches and the respective first and second compositions contained therein.

10. A kit as claimed in claim 1, wherein the activator material is at least one enzyme selected from the group consisting of lipase BCC, Nitrilase enzymes, and enzymes isolated from *Rhodococcus sp.*, and wherein, when the polymeric film of the first pouch is in the presence of the enzyme, the enzyme transforms functional groups on the polymeric film of the first pouch by hydrolysis, oxidation and/or reduction thereby rendering the polymeric film of the first pouch soluble in water.

11. A kit as claimed in claim 1, wherein the activator material is a solid material comprising a ligand selected from the group consisting of 1,2-ethanediol, glycolic acid, lactic acid, sucrose, poly(vinylalcohol), oxalic acid, glycerol, citric acid, and combinations thereof, wherein the ligand is in an amount from 0.5 to 40% by weight of the total weight of the activator, and wherein, when the polymeric film of the first pouch is in the presence of the ligand, the ligand bonds with functional groups on the polymeric film of the first pouch thereby causing the polymeric film of the first pouch to become soluble in water.

12. A kit as claimed in claim 1, wherein the activator material comprises an acid selected from the group consisting of sodium hydrogen sulphate, hydroxycitric acid, sodium hydrogen carbonate, potassium hydrogen tartrate, potassium dihydrogen citrate, sodium hydrogen diglyconate, hydrochloric acid, methane sulphonic acid, toluene sulphonic acid, potassium tetroxalate and short chain organic acids such as propionic and acetic acid.

13. A kit as claimed in claim 1, wherein the wash process is a laundry process, and wherein the first set of conditions is the absence of the activator material in water at the early stage of the rinse cycle of the laundry process, and the second set of conditions is the presence of the activator material in water at the later stage of the rinse cycle, and wherein the second composition contained the second pouch comprises a fabric conditioning composition and the first composition contained in the first pouch comprises a perfume or a super-wetter.

14. A method of treating fabrics in a washing machine laundry treatment process comprising:

dosing the article of the kit of claim 1 into a washing machine drum before a machine cycle commences; and operating the machine to provide the machine cycle including a wash cycle followed by a rinse cycle so that the second composition contained in the second pouch is released at an early stage in the rinse cycle and the first composition contained in the first pouch is released at a later stage of the rinse cycle in the machine cycle.

15. A method of treating fabrics in a washing machine laundry treatment process comprising:

placing the article of the kit of claim 1 into a washing machine drum before the wash cycle commences, dosing the activator material into a rinse compartment of the dispensing drawer of the washing machine before the rinse cycle commences, and operating the machine to provide a wash cycle followed by a rinse cycle so that the activator material is transferred from the dispensing drawer to the drum during the rinse cycle, wherein the polymeric film of the second pouch dissolves during the rinse cycle to release the second composition therein and the polymeric film of the first pouch dissolves at a later stage during the rinse cycle in the presence of the activator material to release the first composition therein.

* * * * *